United States Patent [19]

Tipton et al.

[11] 4,141,328

[45] Feb. 27, 1979

[54] MOTOR DRIVEN ROTARY FUEL PUMP

[75] Inventors: Larry J. Tipton, Florissant; Steven D. Bryant, Fenton, both of Mo.

[73] Assignee: ACF Industries, Incorporated, New York, N.Y.

[21] Appl. No.: 730,456

[22] Filed: Oct. 7, 1976

[51] Int. Cl.[2] ..... F02M 59/12; F02M 41/14; F04B 1/16

[52] U.S. Cl. ..... 123/138; 123/139 E; 417/271

[58] Field of Search ..... 123/138, 139 E, 136, 123/139 AN; 417/271; 91/6.5, 491, 498; 60/39.28 R

[56] References Cited

U.S. PATENT DOCUMENTS

| | | | |
|---|---|---|---|
| 1,274,810 | 8/1918 | Suckert | 123/138 |
| 2,409,477 | 10/1946 | DeLancey | 417/199 |
| 2,881,747 | 4/1959 | Gehner | 123/136 |
| 2,887,060 | 5/1959 | Adams et al. | 417/287 |
| 3,019,779 | 2/1960 | Barfod | 123/139 AN |
| 3,056,357 | 10/1962 | Bohnhoff | 91/475 |
| 3,287,993 | 11/1966 | Lomnicki | 91/498 |
| 3,790,307 | 2/1974 | Aldinger | 417/270 |
| 3,797,469 | 3/1974 | Kobayashi et al. | 123/139 E |
| 3,908,360 | 9/1975 | Meyer et al. | 60/39.28 R |
| 3,980,062 | 9/1976 | Wessel et al. | 123/139 E |
| 4,029,070 | 6/1977 | Kobayashi | 123/139 AN |

*Primary Examiner*—Charles J. Myhre
*Assistant Examiner*—P. S. Lall

[57] ABSTRACT

A motor driven rotary fuel pump particularly adapted to meter fuel flow from a fuel supply line to a two-barrel carburetor of an internal combustion engine. The pump includes a rotor eccentrically mounted in a rotor chamber and having a plurality of pistons mounted in radially extending piston chambers spaced about the circumference of the rotor. An arcuate inlet slot in the housing adjacent the rotor supplies fuel to the piston chambers of the rotor and the fuel from the piston chambers is dispersed into arcuate outlet slots in the housing for discharge into a two-barrel carburetor. The pistons ride in engagement with a peripheral wall surface defining the rotor chamber and the piston chambers register successively with each of the arcuate slots with a dwell portion for the pistons provided by the wall surface between each of the arcuate slots. A drive connection between a drive motor and the rotor continuously urges the rotor into a sealing relation with a face of the rotor chamber.

5 Claims, 9 Drawing Figures

FIG. 1
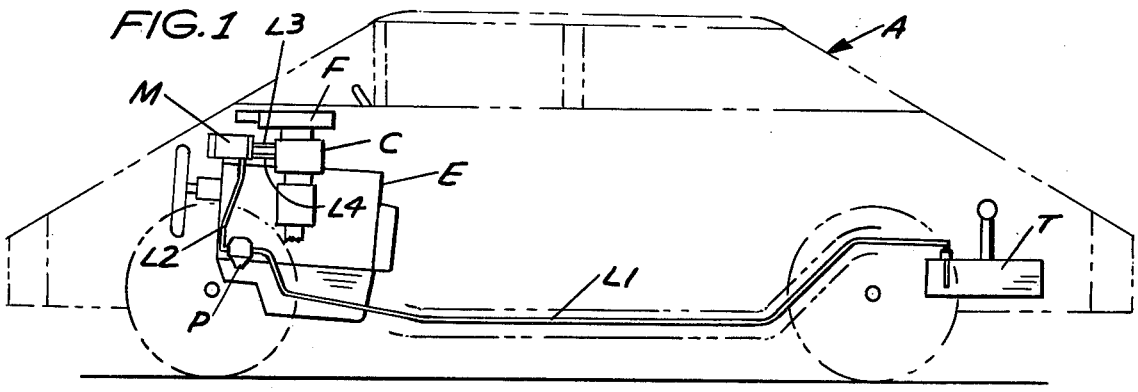
FIG. 2
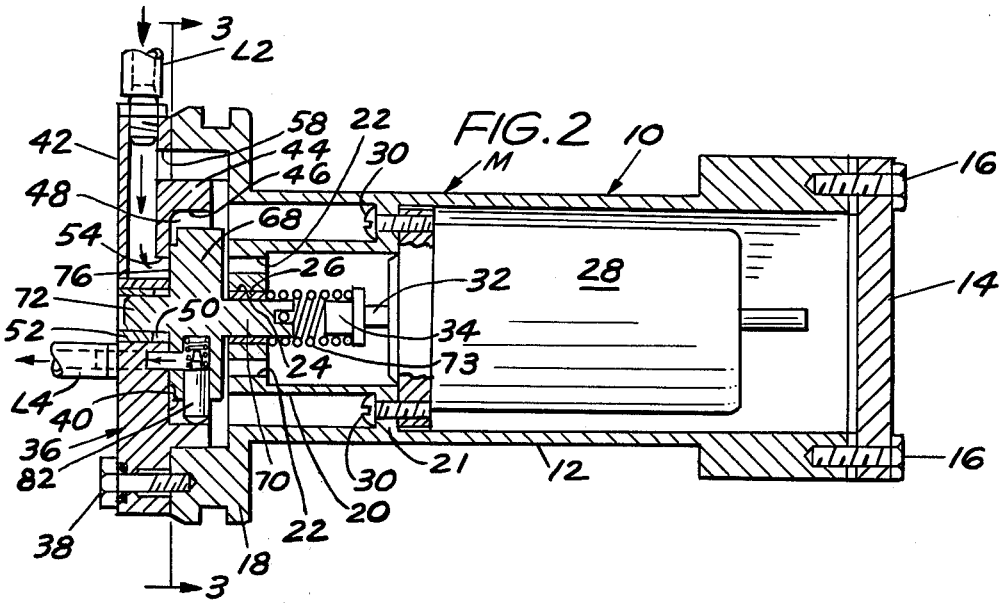
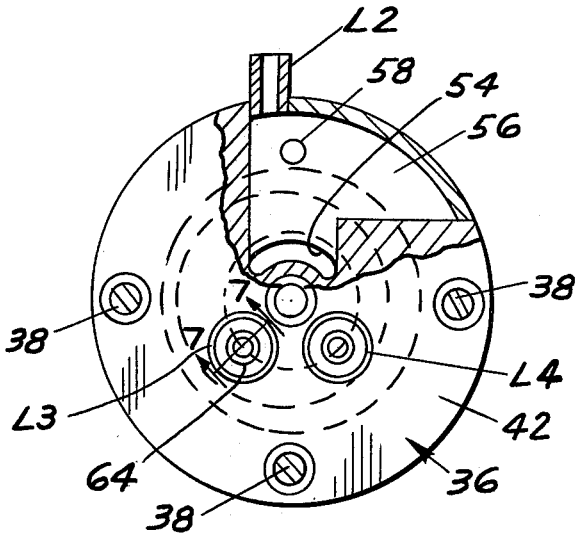
FIG. 6
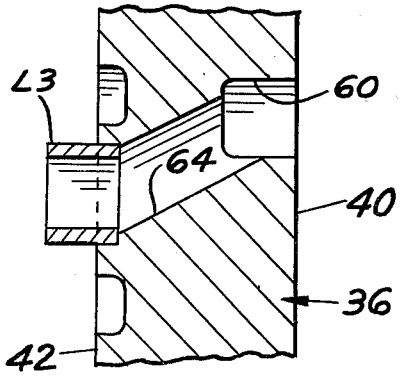
FIG. 7

FIRST DISCHARGE 85°
SECOND DISCHARGE 85°
FLAT 20°
INTAKE - 130°
PISTON STROKE %
ANGLE OF ROTATION

MOTOR DRIVEN ROTARY FUEL PUMP

BACKGROUND OF THE INVENTION

Heretofore, rotary pumps having an eccentrically mounted rotor which receives a fluid from an arcuate inlet slot and discharges the fluid into an arcuate outlet slot have been employed such as shown in U.S. Pat. No. 3,056,357 dated Oct. 2, 1962, which is directed to a rotary pump for a fluid pressure transmission. However, such pumps have not been employed in fuel systems to supply or meter fuel to a carburetor of an internal combustion engine and placed in a fuel line to the carburetor between a fuel supply pump and the carburetor.

It is desirable to have a smooth even flow of fuel to the carburetor. Gasoline is a volatile fluid and easily vaporzies under certain temperature and pressure conditions. Under the variable driving conditions encountered, a wide delivery range is required for a fuel pump. When two-barrel carburetors are employed, it is desirable to have an evenly divided, smooth flow of fuel to each barrel. A precise metering of fuel is also highly desirable to obtain the best fuel consumption rates.

DESCRIPTION OF THE INVENTION

The rotary fuel pump of the present invention is particularly adapted for use with a carburetor to meter the flow of fuel to the carburetor in a fuel system for an internal combustion engine and is placed in the fuel supply line to the carburetor between the fuel supply pump and the carburetor. The rotary pump has a wide operating range between around four hundred (400) revolutions per minute (rpm) to six thousand (6,000) revolutions per minute (rpm) and responds to a gradual acceleration and deceleration of the engine. The pump is preferably employed with a two-barrel carburetor to meter precisely an evenly divided smooth flow of fuel to each barrel.

The fuel pump has a generally cylindrical rotor eccentrically mounted within a rotor chamber formed in the pump housing and the rotor has a plurality of radially spaced piston chambers therein with radially movable pistons therein in continuous contact with the peripheral wall surface of the chamber. The housing has an arcuate inlet slot therein in fluid communication with the rotor chamber and a pair of spaced arcuate outlet slots in the same arc as the inlet slot. Each arcuate slot has at least one piston chamber in fluid communication therewith at all times to even the discharge of fuel from the pistons to the outlet slots. The peripheral wall defining the rotor chamber is in contact with the pistons and has a dwell portion therein for the pistons between each adjacent pair of slot so that the pistons are maintained in a relatively fixed axial position when the pistons are moving from one slot to the next preceding slot during rotation of the rotor. The pistons which are mounted in the piston chambers are of a substantially cylindrical shape to provide a relatively large surface contact area between the outer cylindrical surface of the piston and the adjacent piston chamber wall thereby to permit a relatively high compression ratio if desired. It is particularly desirable to have a relatively large sealing contact between the piston and the adjacent piston wall when employed with gasoline as gasoline has a low viscosity and vaporizes easily under certain conditions of use. The radial movement of the pistons in the piston chambers is such that the fuel is not agitated during suction and delivery strokes of the pistons.

It is an object of the present invention to provide for an automotive fuel system supplying fuel to a carburetor connected to the intake manifold of an internal combustion engine, a metering pump in the fuel supply line between a fuel supply pump and the carburetor.

It is a further object of the present invention to provide an improved rotary fuel pump for a two-barrel carburetor, the pump having a rotor eccentrically mounted in a rotor chamber with an arcuate inlet slot and a pair of arcuate outlets slots in the pump housing adjacent the rotor to receive and discharge fuel therefrom with a generally uniform and equal flow of fuel to each of the carburetor barrels from the outlet slots.

BRIEF DESCRIPTION OF DRAWINGS

In accompanying drawings, in which one of various possible embodiments of the invention is illustrated:

FIG. 1 is a diagrammatic view of an automotive fuel system for an internal combustion engine in which the fuel pump comprising the present invention is positioned in the fuel supply line between a fuel supply pump and a carburetor connected to the internal combustion engine:

FIG. 2 is a longitudinal sectional view of the rotary fuel pump in the fuel system illustrated in FIG. 1;

FIG. 6 is a bottom plan of the end plate shown in FIGS. 4 and 5 with a portion thereof broken away to show the opening therein leading to the arcuate inlet slot;

FIG. 7 is an enlarged section taken generally along line 7—7 of FIG. 6 and showing the outlet for one of the arcuate outlet slots through the end plate;

Referring to FIG. 1 of the drawings, an engine E of an automotive vehicle A has a tank T having a supply of fuel or gasoline therein. The fuel is delivered from tank T through a fluid line L1 to a fuel supply pump P which may be of the well known diaphragm-type fuel pump. Fuel is delivered from fuel pump P through line L2 to the metering pump comprising the present invention indicated generally at M. Metering pump M meters fuel from supply line L2 through two lines L3 and L4 to a carburetor C connected to an intake manifold of engine E. Carburetor C has an air filter F mounted on the air horn thereof and is of a two-barrel type in which fuel is supplied to the carburetor from two separate lines L3 and L4, one line for each barrel or mixture conduit of carburetor C. The present invention is particularly adapted to be employed in a fuel line for an automotive vehicle between a fuel supply pump and the carburetor.

Figure 3:
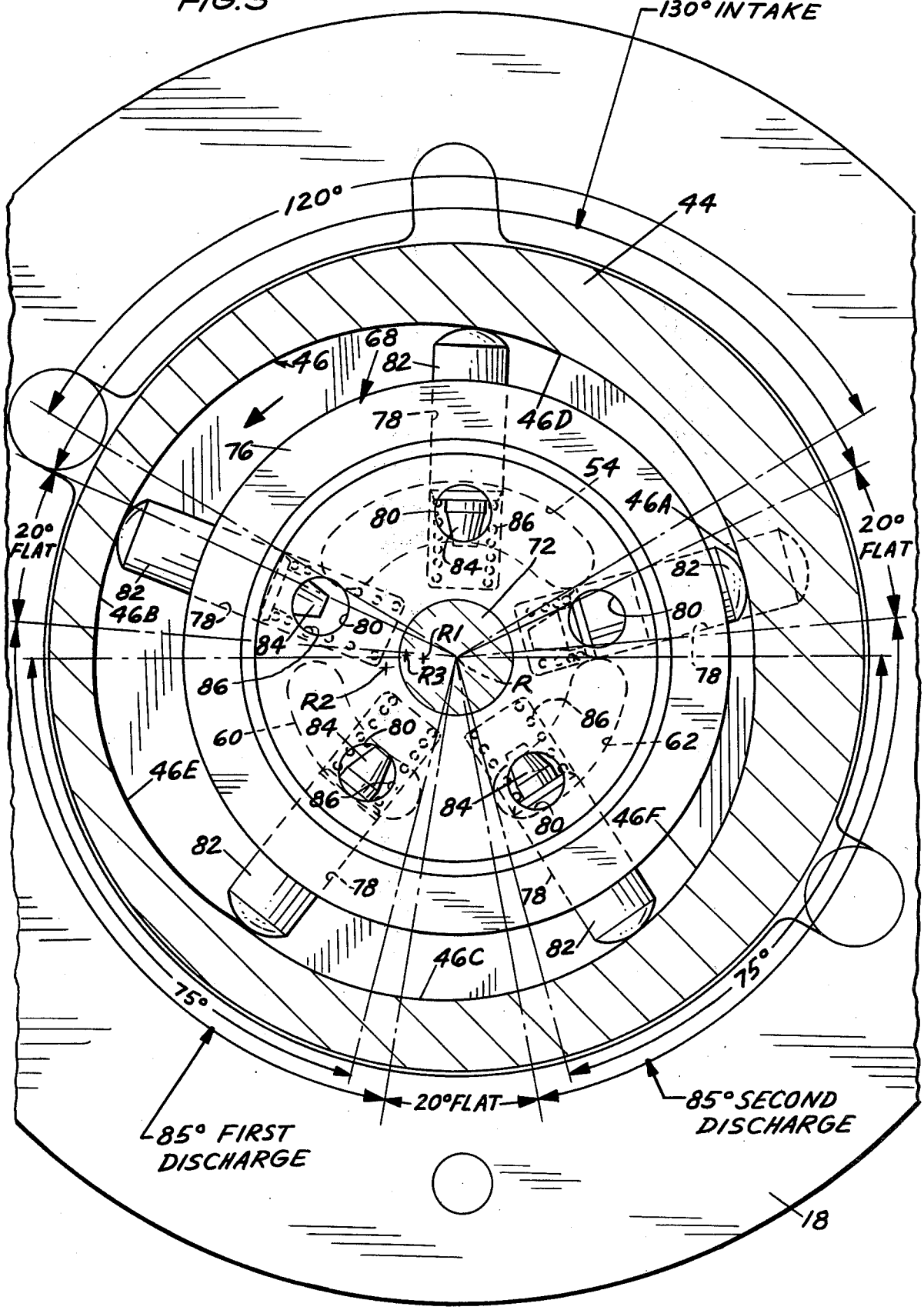
FIG. 3 is an enlarged section taken generally along the line 3—3 of FIG. 2 and illustrating the rotor carrying a plurality of pistons and mounted eccentrically within a rotor chamber with the outer ends of the pistons in contact with the adjacent wall defining the rotor chamber.

Pump M meters the flow of gasoline or fuel from fuel pump P and divides the flow into two lines L3 and L4 to provide an even equal distribution of gasoline to the two air and fuel mixture conduits of carburetor C. Pump M comprises an outer housing generally indicated at 10 having a generally cylindrical outer housing section 12 with an end plate 14 secured thereto by studs 16. An outwardly extending flange 18 on the end of housing section 12 opposite end plate 14 extends around the circumference of housing section 12. An inner cylindrical housing section 20 is connected by a flange 21 to outer section 12. The lower end of inner housing section 20 has openings 22 therein to permit fuel therein. A central shaft opening 24 has a bushing 26 positioned therein.

An electric motor generally indicated at 28 is secured by studs 30 to connecting flange 21 as shown clearly in FIG. 2. Motor 28 may be connected to a suitable source of electrical energy (not shown). A drive shaft 32 extends from motor 28 and has an outer hub 34 thereon.

Housing 10 has an end cam and bearing plate generally indicated at 36 and secured by studs 38 to flange 18 of outer housing section 12. Plate 36 has an inner face 40 and an outer face 42. A circumferential wall 44 extends from inner face 40 and defines an inner peripheral cam surface 46 as clearly shown in FIG. 3. The volume formed or defined by cam surface 46 defines generally a rotor chamber 48 positioned between inner face 40 and the adjacent surface of inner cylindrical housing section 20.

Cam surface 46 as shown in FIG. 3 is not a true circle as will be explained further. As shown in FIG. 3, cam surface 46 includes flat surface portions 46A, 46B and 46C, each comprising around 20° of the circumference for a dwell portion and having a center coincident with the axis of rotation indicated at R. Cam surface portion 46D extends for 130° of the circumference of surface 46 between portions 46A and 46B and forms the intake portion. Cam surface 46E extends for 85° of the circumference of surface 46 between portions 46B and 46C and forms a discharge or outlet portion. Cam surface 46F extends for 85° of the circumference of surface 46 between portions 46C and 46A and forms a second discharge or outlet portion. Arcuate surface portions 46D, 46E and 46F are struck from radii indicated respectively at R1, R2, and R3 on FIG. 3 and therefore do not have a center coincident with radius R.

Figures 4, 5, 8, 9:
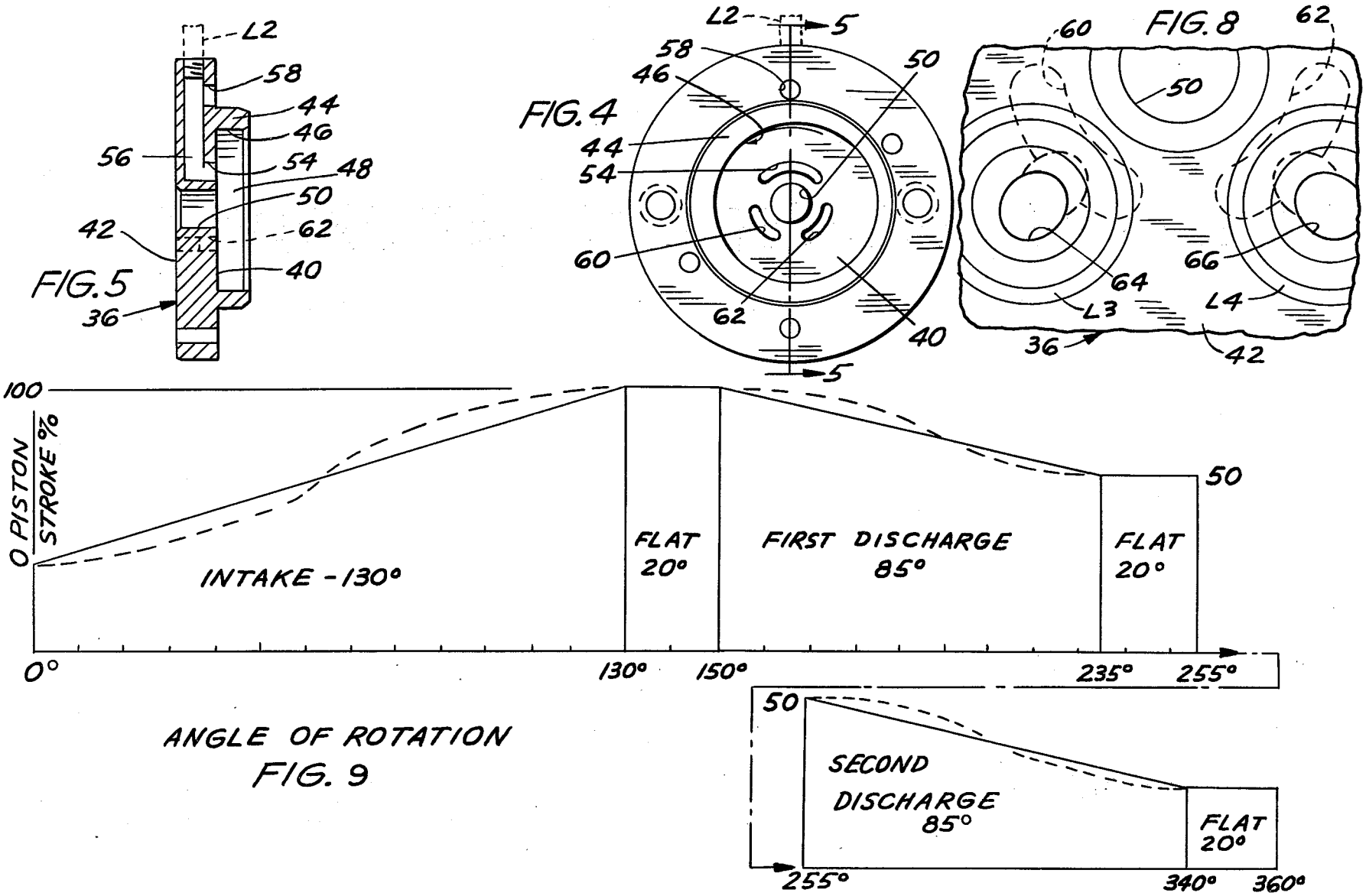
FIG. 4 is a top plan of the housing end plate forming the rotor chamber and showing the arcuate inlet and outlet slots therein.
FIG. 5 is a section taken generally along the line 5—5 of FIG. 4.
FIG. 8 is an enlarged fragment of FIG. 6 illustrating the outlets leading from the arcuate outlet slots.
FIG. 9 is a graphical representation of a cycle of rotor rotation and illustrating the piston stroke or travel for the rotational cycle.

Cam plate 36 has a central opening 50 therein receiving a bushing 52. Inner face 40 of plate 36 has an arcuate inlet slot 54 therein extending for 120° of the arc from rotational axis R. As shown in FIG. 6 a portion of cam plate 36 has been cut away at 56 to provide fuel through opening 58 to rotor chamber 48 and the area adjacent inner housing section 20 to permit cooling of motor 28. Inlet line L2 is connected to plate 36 to supply fuel to inlet slot 54 and opening 58. Arcuate outlet slots 60 and 62 are formed in face 40 in the same arc from radius R as arcuate slot 54 and each of outlet slots 60 and 62 comprises an arc of 75° as shown clearly in FIG. 3. Referring particularly to FIG. 7, arcuate outlet slot 60 is shown and an outlet opening 64 extending through plate 36 communicates with slot 60. Line L3 is connected to outlet opening 64 and fuel from arcuate slot 60 is discharged through opening 64 to line L3 and then to an air and fuel mixture conduit of carburetor C. As shown in FIG. 8, opening 66 communicates with arcuate slot 62 and fuel is supplied through line L4 to another air and fuel mixture conduit of carburetor C. Arcuate slots 54, 60, and 62 have been superimposed on FIG. 3 for the purposes of illustration.

Mounted in chamber 46 is a rotor generally indicated at 68 having a shaft 70 mounted for rotation in bushing 26 in opening 24. A shaft end 72 is mounted for rotation in bushing 52 of opening 50. The outer face 76 of rotor 68 is mounted in fuel fluid sealing contact with the adjacent face 40 of cam plate 36. A drive spring 73 extends between shaft 70 and drive shaft 32 of motor 28. Spring 73 is mounted about hub 34 on the end of drive shaft 32 and torque is transmitted through spring 73 to shaft 70 for rotation of rotor 68. Drive spring 73 continuously urges rotor 68 into engagement with face 40 of cam plate 36 to maintain fluid sealing contact with face 40 of cam plate 36. Rotor 68 has an outer face 76 which is in sealing contact with face 40 of cam plate 36. Rotor 68 has a plurality of radially extending piston chambers 78 therein equally spaced about the circumference of rotor 68. Each piston chamber 78 has an axially extending opening 80 in fluid communication therewith and extending from the associated piston chamber 78 through the outer face 76 of rotor 68. A generally cylindrical piston 82 is mounted within each piston chamber 78 and has an outer end thereof in contact with the adjacent peripheral surface 46 of wall 44. Each piston 82 has an extension 84 on an inner end thereof and a spring 86 within piston chamber 78 continuously urges the associated piston 82 outwardly. Therefore, upon rotation of rotor 68 axial openings 80 align successively with arcuate inlet slot 54 and arcuate outlet slots 60, 62 during a cycle of rotation.

Referring to FIG. 9, a cycle of rotation of rotor 68 is illustrated indicating the position of a single piston 82 with respect to the angle of rotation. A full cycle of rotation is illustrated with a piston 82 with the associated opening 80 being initially aligned with arcuate slot 54 and remaining in communication with arcuate slot 54 for 130° of rotation. It is noted that arcuate slot 54 extends for only 120° of the circumference but an overlap of 5° is provided adjacent each end of arcuate slot 54 by opening 80 to provide fluid communication between arcuate slot 54 and opening 80 for 130° of the cycle of rotation. Five pistons 82 are provided in the invention shown herein with each piston being arranged at a 72° arc with respect to the adjacent piston. Thus, at least one axial opening 80 is in fluid communication with arcuate slot 54 at all times. Arcuate outlet slots 60 and 62 extend for 75° while the opening 80 for piston chamber 78 is in fluid communication with outlet slots 60 and 62 for an 85° arc of the cycle since there is a 5° overlap with opening 80 at each end of arcuate outlet slots 60 and 62. The intake and discharge strokes of a piston 82 are illustrated in FIG. 9 with the solid line indicating the straight line travel of a piston 82 for a cycle of rotation and the broken line indicating the actual movement of a piston 82 for a gradual initial acceleration and a gradual end to deceleration. While the discharge, as shown, is evenly divided between outlet slots 60 and 62, it is to be understood that any proportion of discharge could be arranged by changing the length and/or contour of cam surfaces 46E and 46F with corresponding changes in slots 60 and 62. Thus, cam surface 46E could be extended to an arc length sufficient to achieve total displacement of the pistons 82. In such case, outlet slot 60 would be correspondingly lengthened and surface 46F together with outlet slot 62 would no longer be required. In other words, the first discharge can be varied from 100–0% of the total discharge and the second discharge can be correspondingly varied from 0–100% of the total. Of course, for the two-barrel carburetor herein described, the 50-50 proportioning is best for supplying the correct air-fuel mixture to the engine.

In operation, starting from the initial vertical alignment of an opening 80 with arcuate inlet slot 54, piston 82 in engagement with surface 46D moves outwardly in a suction or intake stroke for a travel of 130° with fuel being supplied to the associated chamber 78 from opening 80 and slot 54 during the outward movement of piston 82. When piston 82 reaches the end of arcuate slot 54, opening 80 moves out of fluid communication with slot 54 and piston 82 engages surface portion 46B which is a dwell or flat portion of surface 46 so that piston 82 is held in a relatively fixed longitudinal position when in engagement with surface portion 46B. When opening 80 is in initial fluid communication with arcuate slot 60, piston 82 contacts surface portion 46E and is cammed inwardly in a discharge stroke until the end of outlet slot 60 is reached. During the time that arcuate slot 60 is in communication with opening 80 the inward movement of piston 82 discharges fuel from opening 80 to arcuate slot 60 and thence through opening 64 and line L3 to an air and fuel mixture conduit of carburetor C. At the end of arcuate slot 60 piston 82 engages surface portion 46C which is a dwell or flat portion of 20° and piston 82 is held in a longitudinally fixed position until arcuate slot 62 is aligned with opening 80 at which time piston 82 engages surface portion 46F and is cammed inwardly by portion 46F in a discharge stroke until the end of arcuate slot 62 is reached. Piston 82 then engages surface portion 46A which is a flat or dwell portion for 20° of the cycle. Fuel is discharged from opening 80 into arcuate outlet slot 62 and thence through opening 66 and line L4 to another air and fuel mixture conduit for carburetor C. Thus, upon a single cycle of rotation fuel is received from inlet 54 and a substantially equal amount of fuel is metered or discharged through arcuate slots 60 and 62 to lines L3 and L4 for the two-barrel carburetor C thereby to supply equal amounts of fuel to the separate mixture conduits of carburetor C.

It is to be noted that arcuate slots 60 and 62 as well as inlet slot 54 have at least one piston opening 80 in fluid communication therewith at all times thereby to provide a generally even distribution of fuel to slots 60 and 62 without any interruptions or unevenness in flow.

The pump M comprising the present invention has a wide operating range and may be rotated between four hundred (400) and six thousand (6,000) revolutions per minute under low or high pressures.

As an example, rotor 68 has an outer diameter of 1.19 inches, cam plate 36 has an outer diameter of 2.70 inches, and each piston 82 has an outer diameter of 0.156 inch. The total travel or stroke of piston 82 is 0.14 inch with each discharge stroke having a piston travel of 0.07 inch. At four hundred (400) rpm's the fuel flow from the discharge outlet is 0.5 pound per minute and at six thousand (6,000) rpm's the fuel flow is 2.2 pounds per minute. A gallon of fuel has a weight of 6.2 pounds. Thus, a wide fuel delivery range is provided.

A relatively large sealing contact area is provided between each of the pistons 82 and the associated piston chambers 78 thereby to permit a relatively high compression ratio if desired without any substantial fuel leakage. Fuel is permitted within rotor chamber 48 through opening 58 and cools motor 28 but does not interfere in any manner with the operation of rotor 68. Metering pump M is employed primarily with gasoline which is a volatile fluid and will vaporize under certain conditions of temperature and pressure. It is desirable to have a good compression ratio and have gradual movements of the pistons during the intake and discharge strokes. The dwell portions of the adjacent wall surface aid in providing a smooth cycle of operation with gradual acceleration and deceleration without any abrupt changes in suction or discharge. By having a piston with a particularly large sealing contact area with its piston chamber, a relatively large seal surface is provided and this is particularly desirable with gasoline since gasoline has a relatively low viscosity.

What is claimed is:

1. In an internal combustion engine, having a fuel supply, a carburetor connected to the intake manifold of the internal combustion engine, a fuel supply line extending from the fuel supply to the carburetor, and a fuel supply pump in the supply line to the carburetor; the improvement comprising a motor driven fuel metering pump in the supply line between the fuel supply pump and the carburetor to meter the supply of fuel from the supply pump to the carburetor, said fuel metering pump including a fixed housing having a rotor chamber therein with an inner peripheral wall surface, a rotor eccentrically mounted within the rotor chamber, said rotor having a plurality of radially extending piston chambers therein, each piston chamber having a piston therein with an outer end thereof extending outwardly beyond the circumference of the rotor and in continuous contact with the inner peripheral wall surface defining the rotor chamber to move in a radial direction during rotation of the rotor, a fuel inlet from the fuel supply line in fluid communication with the piston chamber during a portion of the rotation of the rotor to supply fuel to the piston chamber, and a fuel outlet to the carburetor in fluid communication with the piston chamber during a separate portion of the rotation of the rotor to supply fuel to the carburetor.

2. In an internal combustion engine, having a fuel supply, a two-barrel carburetor connected to the intake manifold of the internal combustion engine, and a fuel supply line extending from the fuel supply to the carburetor; the improvement comprising a motor driven fuel metering pump in the supply line between the fuel supply pump and the carburetor to dispense substantially equal amounts of fuel to each of the two barrels of the carburetor, said fuel metering pump including a fixed housing having a rotor chamber therein, a rotor mounted within the rotor chamber, a fuel inlet in fluid communication with the rotor chamber to receive fuel from the fuel supply line and a pair of fuel outlets in fluid communication with the rotor chamber and the two barrels of the carburetor to discharge substantially equal amounts of fuel to said two barrels upon rotation of rotor.

3. In an internal combustion engine, having a fuel supply, a two-barrel carburetor connected to the intake manifold of the internal combustion engine, a fuel supply line extending from the fuel supply to the carburetor, and a fuel supply pump in the supply line to provide fuel to the carburetor; the improvement comprising a motor driven fuel metering pump in the supply line between the fuel supply pump and the carburetor to dispense substantially equal amounts of fuel to each of the two barrels of the carburetor, said fuel metering pump including a fixed housing having a rotor chamber therein with an inner peripheral wall surface, a rotor eccentrically mounted within the rotor chamber, said rotor having a plurality of radially extending piston chambers therein, each piston chamber having a piston therein with an outer end extending outwardly beyond the circumference of the rotor and in continuous contact with the inner peripheral wall surface defining the rotor chamber to move in a radial direction during rotation of the rotor, a fuel inlet from the fuel supply line in selective fluid communication with the inner end of each piston chamber during an outward movement of the associated piston upon rotation of the rotor to supply fluid to the piston chamber, and a pair of fluid outlets to the carburetor in selective fluid communication with the said inner end of each piston chamber during an inward movement of the associated piston to discharge substantially equal amounts of fuel to said two barrels of the rotor.

4. The combination as set forth in claim 3 wherein at least one piston chamber is in fluid communication at all times with the inlet and each of the outlets during rotation of the rotor thereby to provide an even and continuous fuel flow to the two barrels of the carburetor.

5. In an automotive fuel system for supplying fuel to an internal combustion engine, a fuel supply, a carburetor connected to the intake manifold of the internal combustion engine, a fuel supply line extending from the fuel supply to the carburetor, a fuel supply pump in the supply line to provide fuel to the carburetor, and a fuel metering pump in the supply line between the carburetor and fuel supply pump to meter the supply of fuel to the carburetor from the fuel supply pump, said fuel metering pump including a drive motor, a fixed housing having a rotor chamber therein with an inner peripheral wall surface, a rotor eccentrically mounted with the rotor chamber with a varying circumferential space formed between the outer periphery of the rotor and the inner adjacent peripheral wall surface of the rotor chamber, means connecting the motor and the rotor in a driving relation, said housing having an inlet to receive fuel from the fuel supply line and an outlet to dispense fuel to the carburetor, said rotor carrying a plurality of radially movable pistons in continuous contact with the peripheral wall surface of the chamber during rotation of the rotor and movable inwardly by contact with the wall surface, said pistons being mounted in piston chambers and extending radially from the rotational axis of the rotor with each of said piston chambers being in selective fluid communication with the inlet and outlet when aligned therewith upon rotation of the rotor, said piston chambers receiving fuel from the inlet upon outward radial movement of the pistons when aligned with the inlet and discharging fuel into the outlet upon an inward radial movement of the pistons when aligned with the outlet.

* * * * *